US006247446B1

(12) United States Patent
Fassler et al.

(10) Patent No.: US 6,247,446 B1
(45) Date of Patent: Jun. 19, 2001

(54) ELECTRONIC ENGINE CONTROL FOR REGULATING ENGINE COOLANT TEMPERATURE AT COLD AMBIENT AIR TEMPERATURES BY CONTROL OF ENGINE IDLE SPEED

(75) Inventors: Jeffrey E. Fassler, Chicago; Titus J. Iwaszkiewicz, Woodridge; Rogelio Rodriguez, Berwyn; Raymond J. Slowinski, Lemont, all of IL (US)

(73) Assignee: Navistar International Transportation Corp, Chicago, IL (US)

( * ) Notice: Subject to any disclaimer, the term of this patent is extended or adjusted under 35 U.S.C. 154(b) by 0 days.

(21) Appl. No.: 09/510,772

(22) Filed: Feb. 23, 2000

Related U.S. Application Data

(62) Division of application No. 08/962,587, filed on Oct. 31, 1997.

(51) Int. Cl.[7] ..... F02M 3/06
(52) U.S. Cl. ..... 123/339.22; 123/339.24
(58) Field of Search ..... 123/339.22, 339.24, 123/142.5 R

(56) References Cited

U.S. PATENT DOCUMENTS 4,484,552 * 11/1984 Kobayashi et al. ..... 123/339.22
4,580,536 * 4/1986 Takao et al. ..... 123/339.22
4,886,025 * 12/1989 Bonfiglioli et al. ..... 123/339.22
5,235,946 * 8/1993 Fodale et al. ..... 123/585
5,309,882 * 5/1994 Hoshiba et al. ..... 123/339.24
5,605,128 * 2/1997 Nusser et al. ..... 123/339.24
5,806,486 * 9/1998 Gee et al. ..... 123/339.24

* cited by examiner

*Primary Examiner*—Erick Solis
(74) *Attorney, Agent, or Firm*—Dennis Kelly Sullivan; Jeffrey P. Calfa

(57) ABSTRACT

An electronic engine control for reducing, and ideally eliminating, accumulation of products of incomplete combustion that result from cold ambient conditions acting on the engine and that otherwise might ultimately affect engine operation before the useful life of an engine has elapsed. An idle speed control has a first source providing a signal corresponding to ambient air temperature, a second source providing a signal corresponding to engine coolant temperature, a third source providing a signal indicating that an engine is running substantially in an idle condition, and a processor that processes the signals from the first source, the second source, and the third source to develop an idle speed control signal for controlling engine idle speed by regulating the engine coolant temperature to a defined coolant temperature when the engine is running in an idle condition and the ambient air temperature does not concurrently exceed a defined air temperature. The engine coolant temperature is regulated to substantially 63° C. (145.4° F.) when the ambient air temperature does not concurrently exceed substantially 0° C. (32° F.). Also included are a proportional and integral control that processes an error signal developed from engine coolant temperature feedback to the processor to develop the idle speed control signal, and a fault detection circuit.

18 Claims, 2 Drawing Sheets

ELECTRONIC ENGINE CONTROL FOR REGULATING ENGINE COOLANT TEMPERATURE AT COLD AMBIENT AIR TEMPERATURES BY CONTROL OF ENGINE IDLE SPEED

This is a division of application Ser. No. 08/962,587, filed Oct. 31, 1997.

FIELD OF THE INVENTION

This invention relates generally to engine controls for automotive vehicles and more particularly to an electronic engine control that regulates engine coolant temperature during cold ambient temperatures by adjustment of engine idle speed. The invention is especially suited for automotive vehicles, such as trucks, that are powered by diesel engines.

BACKGROUND AND SUMMARY OF THE INVENTION

Starting and idling of an automotive vehicle's internal combustion engine during cold weather may subject various engine parts to harsher operating conditions than those experienced during warmer weather and/or after the engine has warmed up. An engine's valve train, for example, may contain such parts. Combustion processes occurring during cold weather starting and idling may be incomplete, and over time cause certain products of such incomplete combustion to accumulate as deposits that can affect proper valve train operation.

The present invention relates to an improvement for reducing, and ideally eliminating, accumulation of products of incomplete combustion that result from cold ambient conditions acting on the engine and that otherwise might ultimately affect engine operation before the useful life of an engine has elapsed.

A presently preferred embodiment of the invention is well-suited for integration with an engine electronic control. One example of a engine electronic control with which the present invention is useful may be found in U.S. Pat. No. 5,357,912 relating to a diesel engine.

One general aspect of the invention relates to an idle speed control for an internal combustion engine comprising a first source providing a signal corresponding to ambient air temperature, a second source providing a signal corresponding to engine coolant temperature, a third source providing a signal indicating that an engine is running substantially in an idle condition, and a processor that processes the signals from the first source, the second source, and the third source to develop an idle speed control signal for controlling engine idle speed by regulating the engine coolant temperature to a defined coolant temperature when the engine is running in an idle condition and the ambient air temperature does not concurrently exceed a defined air temperature.

Another general aspect of the invention relates to an idle speed control for an internal combustion engine that powers an automotive vehicle via a vehicle drivetrain comprising multiple sources providing respective signals relating to respective parameters of automotive vehicle operation, one of which signals is an ambient air temperature signal, and a processor that processes the respective signals to develop an idle speed control signal that controls engine idle speed when the engine is running in an idle condition and the ambient air temperature does not concurrently exceed a defined temperature.

Still another general aspect of the invention relates to an automotive vehicle having an engine that powers the vehicle via a drivetrain, and an electronic engine control for controlling functions related to operation of the engine, and comprising multiple sources providing respective signals relating to respective parameters relevant to vehicle operation, one of which signals is an ambient air temperature signal, and a processor that processes the respective signals to develop a speed control signal for controlling engine speed when the engine is running disengaged from the drivetrain and when the ambient air temperature does not concurrently exceed a defined temperature.

Still another general aspect of the invention relates to an automotive vehicle having an engine that powers the vehicle via a drivetrain, and an electronic engine control for controlling functions related to operation of the engine, and comprising multiple sources providing respective signals relating to respective parameters relevant to vehicle operation, a first of which signals is an ambient air temperature signal representing current ambient air temperature and a second of which is an engine coolant temperature signal representing current engine coolant temperature, and a processor that processes the respective signals to develop a speed control signal for controlling engine speed by regulating the engine coolant temperature to a defined coolant temperature when the engine is running disengaged from the drivetrain and the ambient air temperature does not concurrently exceed a defined air temperature.

Other aspects of the invention concern regulating the engine coolant temperature to substantially 63° C. (145.4°F.) when the engine is running in an idle condition and the ambient air temperature does not concurrently exceed substantially 0°C. (32° F.), the incorporation of a proportional and integral control that processes an error signal developed from engine coolant temperature feedback to the processor to develop the idle speed control signal, and the incorporation of a fault detection circuit.

The foregoing, along with further features and advantages of the invention, will be seen in the following disclosure of a presently preferred embodiment of the invention depicting the best mode contemplated at this time for carrying out the invention. The disclosure includes drawings, as now briefly described.

DESCRIPTION OF THE PREFERRED EMBODIMENT

Figure 1A:
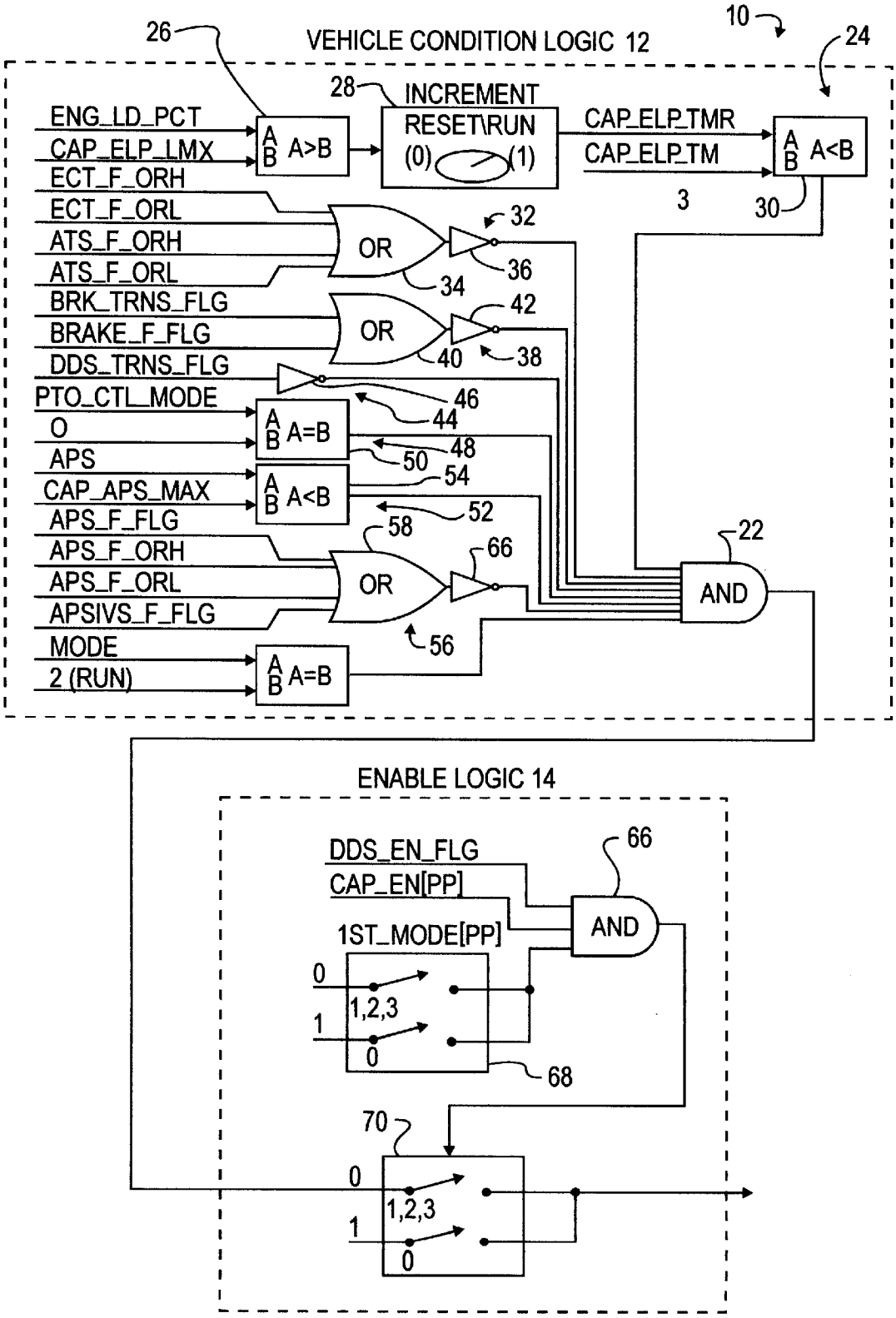
FIGS. 1A–1B is an electrical schematic diagram of that portion of an electronic engine control embodying principles of the present invention.
Figure 1B:
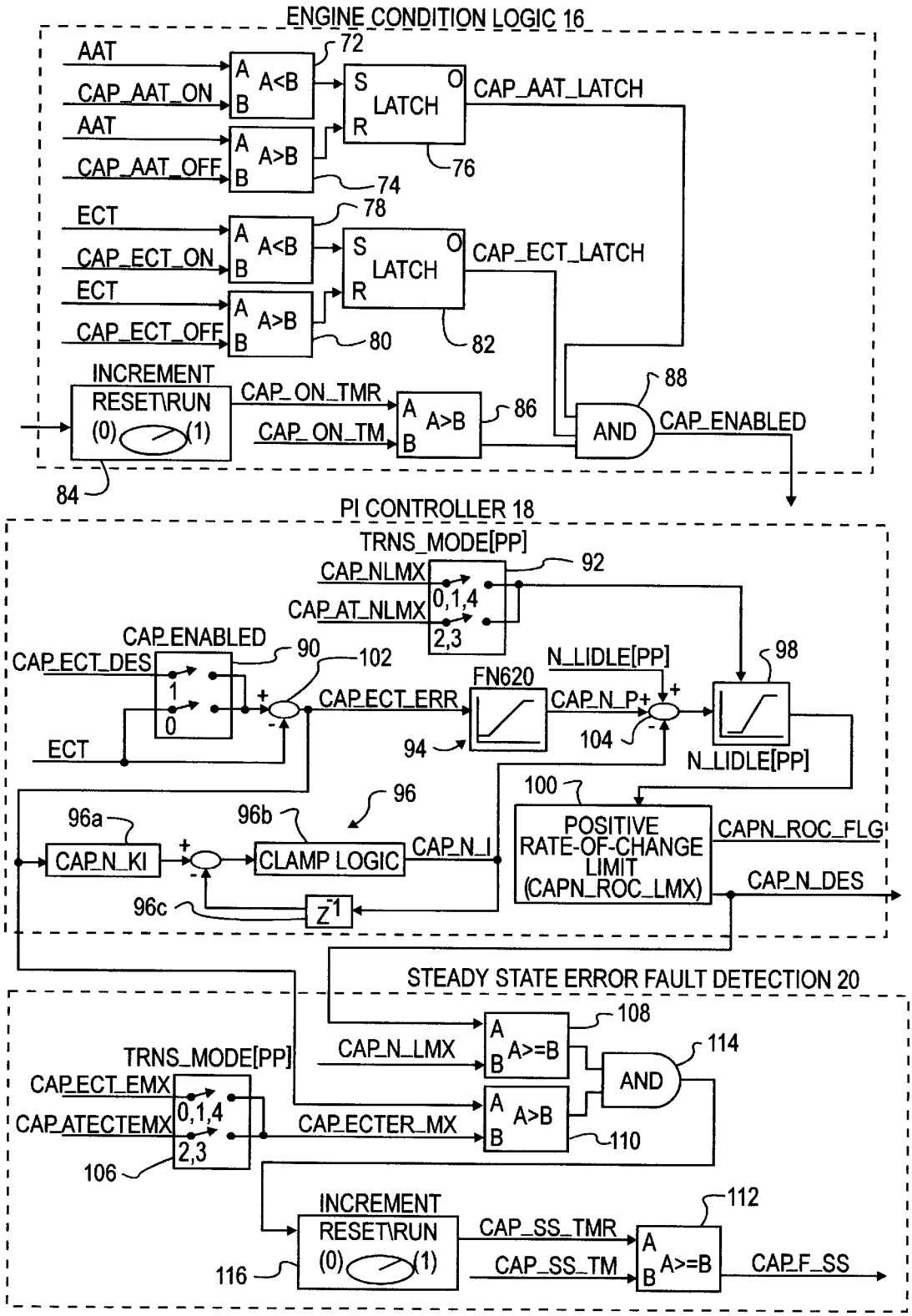

FIG. 1 shows an embodiment of an engine idle speed control circuit 10 embodying principles of the present invention. Although FIG. 1 is shown and described in terms of discrete electronic hardware components arranged in a specific configuration, it should be understood that generic principles of the invention are not necessarily limited to any particular configuration, be it discrete hardware components or software embodied in a microcomputer control. Indeed, the embodiment of FIG. 1 may be considered to correspond to portions of a microcomputer programmed with software to perform the functions of the particular components illustrated in the FIG. Circuit 10 serves to control a liquid-cooled diesel engine that powers an automotive vehicle via a drivetrain which, for example, includes a transmission (either automatic or manual), a clutch in the case of a manual transmission, a driveshaft, and an axle.

For convenience of explanation, circuit 10 is considered to comprise a vehicle condition logic circuit 12, an enable logic circuit 14, an engine condition logic circuit 16, a PI controller circuit 18, and a steady state error fault detection circuit 20.

Vehicle condition logic circuit 12 receives a number of input signals related to states and/or values of certain vehicle operating parameters and/or devices of an automotive vehicle. The designations of these input signals appear in FIG. 1. Basically, vehicle condition logic circuit 12 enables circuit 10 to exercise control of engine idle speed when states and/or values of certain vehicle operating parameters and/or devices simultaneously satisfy certain criteria, but circuit 12 does not inherently require that control actually be exercised. As will be seen from ensuing description, circuits 14 and 16 are also factors in determining whether or not idle speed control in fact occurs.

For the enablement of such idle speed control to be exercised, circuit 12 requires that the following conditions simultaneously exist. 1) Actual engine load must be less than a certain percentage (25% for example) of maximum allowable engine load, i.e. 100% engine load. 2) No faults in an engine coolant temperature sensor, or in an ambient air temperature sensor, or in any circuitry associated with either, must be detected. 3) No brake pedal transition or fault in a brake pedal sensor, or any related circuitry, must be detected. 4) No drivetrain transition must be detected. 5) No enablement of an engine power take-off must be detected. 6) No accelerator transition must be detected. 7) No fault in an accelerator position sensor or any related circuitry must be detected. 8) The engine must be detected to be in run mode, not in any other mode, such as a service diagnostic mode.

Engine condition logic circuit 16 allows, but does not inherently mandate, circuit 10 to exercise control of engine idle speed when certain conditions simultaneously exist. These conditions include the following. 1) Ambient air temperature is below a defined ambient air temperature. 2) Engine coolant temperature is below a defined engine coolant temperature. 3) Enable logic circuit 14 is passing a signal from vehicle condition logic circuit 12 to engine condition logic circuit 16 indicating that the various criteria that are required to satisfy circuit 12 for allowing control to be exercised, are present.

Enable logic circuit 14 selectively couples vehicle condition logic circuit 12 with engine condition logic circuit 16, enabling cold ambient control of engine idle speed to occur essentially only when the vehicle drivetrain is disengaged from the engine and the engine is running substantially at idle speed.

PI controller circuit 18 comprises a closed loop proportional and integral control that is effective to adjust engine idle speed when engine condition logic circuit 16 is enabled by circuits 12 and 14 to allow circuit 10 to be effective to cause the engine idle speed to be adjusted such that the engine coolant temperature is regulated to a defined temperature when ambient air temperature is below a defined temperature. Adjustment of the idle speed of an engine that has an engine driven coolant pump adjusts the circulation of liquid coolant through the engine cooling system. A known engine cooling system comprises a radiator through which coolant is allowed to flow once the coolant temperature has become sufficiently high that engine heat should be rejected to atmosphere via the radiator. A thermostat valve that is properly functioning in the cooling system allows flow through the radiator when a sufficiently high tempertaure has been exceeded, but otherwise disallows flow. One of the conditions that is required for allowing idle speed to be controlled in accordance with the principles of the present invention is that engine coolant temperature must be less than the defined engine coolant temperature referred to earlier. That defined engine coolant temperature is less than the temperature at which the thermostat valve allows coolant flow through the radiator.

Steady state error fault detection circuit 20 monitors certain parameters to detect and flag a fault in the engine microcomputer when called for by a fault in any of such parameters.

Vehicle condition logic circuit 12 comprises a single AND logic gate 22 at its output. Within circuit 12 there are eight inputs to AND gate 22 from respective input circuits.

A first input to AND gate 22 is from an engine load sensing circuit 24. Circuit 24 comprises a first comparator 26, a timer 28, and a second comparator 30.

Comparator 26 compares two respective input signals, designated ENG_LD_PCT and CAP_ELP_LMX, and controls the operation of timer 28 in accordance with the comparison. Whenever the latter signal exceeds the former, comparator 26 provides a binary "0" output signal as an input to timer 28, causing timer 28 to be in a reset state, and hence not run. Whenever the former signal exceeds the latter, comparator 26 provides a binary "1" output signal as an input to timer 28, releasing timer 28 from its reset state so that the timer runs. Signal ENG_LD_PCT represents a measurement of the present actual load on the engine as a percentage of maximum allowable engine load. Signal CAP_ELP_LMX represents, also as a percentage of maximum allowable engine load, a maximum limit for present actual engine load that does not disallow circuit 10 from exercising control over engine idle speed. Consequently, whenever the actual engine load percentage represented by signal ENG_LD_PCT exceeds the maximum allowable engine load percentage represented by signal CAP_ELP_LMX, timer 28 runs; otherwise timer is reset to remain at zero time.

Comparator 30 compares the elapsed running time of timer 28, designated by the signal CAP_ELP_TMR, with a defined amount of time designated by the signal CAP_ELP_TM. So long as the elapsed time as measured by timer 28 remains less than that defined amount of time, comparator 30 provides a "1" binary output signal as an input to AND gate 22. Once the elapsed time as measured by timer 28 has exceeded that defined amount of time, comparator 30 provides a binary "0" output signal to AND gate 22. Consequently, whenever the measured actual engine load percentage has continuously exceeded the maximum allowable engine load percentage for that defined amount of time, the output of comparator 30 switches from delivering a binary "1" signal to AND gate 22 to delivering a binary "0" signal. Should the measured actual engine load percentage drop below that maximum allowable engine load percentage before the amount of time allowed by signal CAP_ELP_TM has elapsed, then timer 28 is reset to zero by comparator 26. Accordingly, whenever the timer runs for an amount of time greater than the amount of time allowed by signal CAP_ELP_TM, circuit 10 is prevented from exercising control over engine idle speed.

A second input to AND gate 22 is from a temperature sensing circuit 32. Circuit 32 comprises an OR gate 34 and an inverter 36, which are collectively equivalent to a NOR gate. OR gate 34 receives four respective input signals designated ECT_F_ORH, ECT_F_ORL, ATS_F_ORH, and ATS_F_ORL. So long as any of these four input signals is a binary "1", inverter 36 provides a "0" binary output signal as an input to AND gate 22. Hence, only when all four input signals are binary "0's" does circuit 32 provide a binary "1" signal to AND gate 22.

A purpose of temperature sensing circuit 32 is to monitor both the engine coolant temperature sensor, and any related circuitry, and the ambient air temperature sensor, and any related circuitry, for faults. Each signal is derived internally of the engine microcomputer. Whenever any of the signals ECT_ORH, ECT_F_ORL, ATS_F_ORH, and ATS_F_ORL becomes a binary "1", such occurrence is an indication of a fault. Signal ECT_F_ORH becomes a binary "1" if the engine microcomputer detects that the engine coolant temperature sensor is giving a signal indicative of coolant temperature being greater than a certain maximum that is deemed indicative of a fault in the sensor or in any circuitry associated with the sensor. Signal ECT_F_ORL becomes a binary "1" if the engine microcomputer detects that engine coolant temperature sensor is giving a signal indicative of coolant temperature being less than a certain minimum that is deemed indicative of a fault in the sensor or in any circuitry associated with the sensor. Signal ATS_F_ORH becomes a binary "1" if the engine microcomputer detects that the ambient air temperature sensor is giving a signal indicative of ambient air temperature being greater than a certain maximum that is deemed indicative of a fault in the sensor or in any circuitry associated with the sensor. Signal ATS_F_ORL becomes a binary "1" if the engine microcomputer detects that the ambient air temperature sensor is giving a signal indicative of ambient air temperature being less than a certain minimum that is deemed indicative of a fault in the sensor or in any circuitry associated with the sensor.

A third input to AND gate 22 is from a service brake sensing circuit 38. Circuit 38 comprises an OR gate 40 and an inverter 42, which are collectively equivalent to a NOR gate. OR gate 40 receives two respective input signals designated BRK_TRNS_FLG and BRAKE_F_FLG. So long as either of these two input signals is a binary "1", inverter 42 provides a "0" binary output signal as an input to AND gate 22. Hence, only when both input signals are binary "0's" does circuit 38 provide a binary "1" signal to AND gate 22. Each signal BRK_TRNS_FLG and BRAKE_F_FLG is derived internally of the engine microcomputer from appropriate signals that are used to define each signal BRK_TRNS_FLG and BRAKE_F_FLG. Whenever either signal BRK_TRNS_FLG and BRAKE_F_FLG becomes a binary "1", such occurrence is an indication of a fault. Signal BRK_TRNS_FLG changes from a binary "0" to a binary "1" if a change in the condition of a service brake sensor, such as a brake pedal switch for instance, indicative of brake pedal operation (due to either brake application or brake release), is given. Signal BRAKE_F_FLG changes from a binary "O" to a binary "1" if a fault in the brake switch or associated circuitry has been detected.

A fourth input to AND gate 22 is from a drivetrain sensing circuit 44. Circuit 44 comprises an inverter 46 which receives a single input signal designated DDS_TRNS_FLG. When this input signal is a binary "1", inverter 46 provides a binary "0" output signal as an input to AND gate 22, and when the input signal is a binary "0", circuit 44 provides a binary "1" output signal to AND gate 22. The signal DDS_TRNS_FLG is derived internally of the engine microcomputer and changes from a binary "0" to a binary "1" when the vehicle drivetrain ceases to be disengaged, such as by being placed in gear. Accordingly, when the signal DDS_TRNS_FLG is a binary "0", it indicates that the vehicle drivetrain is disengaged from the engine.

A fifth input to AND gate 22 is from a power take-off (PTO) mode detection circuit 48. Circuit 48 comprises a device 50 which receives an input signal designated PTO_CTL_MODE and a fixed binary "0" logic signal. Only when signal PTO_CTL_MODE is a binary "0" logic signal does device 50 supply a binary "1" signal to AND gate 22. The PTO_CTL_MODE signal is a binary loll logic signal so long as the engine has not been placed in a mode which enables an auxiliary device (meaning a device other than the vehicle's drivetrain) to be operated by the engine.

A sixth input to AND gate 22 is from an accelerator position sensing circuit 52. Circuit 52 comprises a comparator 54 which receives respective input signals designated APS and CAP_APS_MAX. Comparator 54 compares these two input signals. Whenever the former input signal exceeds the latter, comparator 54 provides a "0" binary output signal as an input to AND gate 22. Whenever the latter exceeds the former, comparator 54 provides a binary "1" output signal to AND gate 22. Signal APS is developed by the engine microcomputer to represent the position of the vehicle accelerator as detected by an accelerator position sensor. Signal CAP_APS_MAX represents a maximum allowable value corresponding to a maximum allowable position of the accelerator away from non-actuated position that will still allow circuit 10 to exercise control of engine idle speed. Consequently, whenever the accelerator is operated to a position not beyond the maximum allowable position away from non-actuated position that will allow circuit 10 to exercise control of engine idle speed, circuit 52 delivers a "1" binary signal to AND gate 22, allowing such enablement; and whenever the accelerator is operated to a position beyond the maximum allowable position away from non-actuated position that will allow circuit 10 to exercise control of engine idle speed, circuit 52 delivers a "0" binary signal to AND gate 22, disallowing such enablement. A seventh input to AND gate 22 is from an accelerator condition sensing circuit 56. Circuit 56 comprises an OR gate 58 and an inverter 60, which are collectively equivalent to a NOR gate. OR gate 58 receives four respective signals designated APS_F_FLG, APS_F_ORH, APS_F_ORL, and APSIVS_F_FLG. So long as any of these four signals is a binary "1", inverter 60 provides a "0" binary output signal as an input to AND gate 22. Hence, only when all four input signals are binary "0's" does circuit 56 provide a binary "1" output signal to AND gate 22. Signals APS_F_FLG, APS_F_ORH, APS_F_ORL, and APSIVS_F_FLG are derived internally of the engine microcomputer. Whenever any of these signals APS_F_FLG, APS_F_ORH, APS_F_ORL, and APSIVS_F_FLG becomes a binary "1", such occurrence is an indication of a fault. Signal APS_F_FLG becomes a binary "1" if a condition indicative of a fault in the accelerator position sensor, or in circuitry associated with the sensor, occurs. Signal APS_F_ORL becomes a binary "1" if the accelerator position sensor gives a signal indicative of a position being less than a certain minimum that is deemed indicative of a fault in the sensor or in circuitry associated with the sensor. Signal APS_F_ORH becomes a binary "1" if the accelerator position sensor gives a signal indicative of being greater than a certain maximum that is deemed indicative of a fault in the sensor or in circuitry associated with the sensor. Signal APSIVS_F_FLG becomes a binary "1" if an accelerator position sensor idle validation switch that distinguishes between idle and non-idle positions of the accelerator pedal detects an in-range failure of the accelerator position sensor.

An eighth input to AND gate 22 is from an engine run mode sensing circuit 62. Circuit 62 comprises a device 64 which receives respective input signals designated MODE and 2(RUN) from internally of the engine microcomputer. The signal 2(RUN) is always constant. The signal MODE indicates any of several different engine operating modes, such as run, crank, no run. Only when the MODE signal indicates run mode by assuming a state identical to the 2(RUN) signal at the other input of device 64, does device 64 give a binary "1" output signal to AND gate 22.

Enable logic circuit 14 comprises an AND gate 66, a first switch device 68 (designated 1ST_MODE[PP]), and a second switch device 70. AND gate 66 receives three respective input signals, a first of which is designated DDS_EN_FLG, a second of which is designated CAP_EN[PP], and a third of which is an output of first switch device 68. AND gate 66 controls the condition of second switch device 70. When the output of AND gate 66 is a binary "1", device 70 functions to couple the output of AND gate 22 through to engine condition logic circuit 16. When the output of AND gate 66 is a binary "0", device 70 functions to de-couple the output of AND gate 22 from engine condition logic circuit 16 and instead deliver a binary "0" to engine condition logic circuit 16. Accordingly, enable logic circuit 14 selectively allows and disallows passage of the signal output of AND gate 22 to engine condition logic circuit 16.

Signal DDS_EN_FLG indicates whether or not the vehicle drivetrain is being coupled in driven relation with the engine. When that signal is a binary "1", it indicates that the drivetrain is disengaged from the engine, and when it is a binary "0", it indicates that the drivetrain is engaged, meaning that the drivetrain is in driven relationship with the engine. Signal CAP_EN[PP] is a programmable parameter that provides a means for enabling the vehicle manufacturer to either enable or disable the operation of the cold ambient protection function. When the signal is a binary "0", the function is disabled; when it is a binary "1", the function is enabled. Device 68 is set to either one of two conditions depending upon whether the transmiagion of the vehicle drivetrain is a manual or an automatic transmission.

Engine condition logic circuit 16 comprises a first comparator 72, a second comparator 74, a first latch 76, a third comparator 78, a fourth comparator 80, a second latch 82, a timer 84, a fifth comparator 86, and an AND gate 88. Comparator 72 receives and compares respective input signals designated AAT and CAP_AAT_ON. Whenever the former input signal exceeds the latter, comparator 72 provides a "0" binary signal to the set input of latch 76. Whenever the latter exceeds the former, comparator 72 provides a binary "1" signal to the set input of latch 76.

Comparator 74 receives and compares respective input signals designated AAT and CAP_AAT_OFF. Whenever the latter input signal exceeds the former, comparator 74 provides a "0" binary signal to the reset input of latch 76. Whenever the former exceeds the latter, comparator 74 provides a binary "1" signal to the reset input of latch 76.

Comparator 78 receives and compares respective input signals designated ECT and CAP_ECT_ON. Whenever the former input signal exceeds the latter, comparator 78 provides a "0" binary signal to the set input of latch 82. Whenever the latter exceeds the former, comparator 78 provides a binary "1" signal to the set input of latch 82.

Comparator 80 receives and compares respective input signals designated ECT and CAP_ECT_OFF. Whenever the latter input signal exceeds the former, comparator 80 provides a "0" binary signal to the reset input of latch 82. Whenever the former exceeds the latter, comparator 80 provides a binary "1" signal to the reset input of latch 82.

AND gate 88 receives three respective input signals, a first of which is received from latch 76 and designated CAP_AAT_LATCH, a second of which is received from latch 82 and designated CAP_ECT_LATCH, and a third of which is an output of comparator 86. The output of AND gate 88 controls the condition of a switch device 90 (designated CAP_ENABLED) of PI controller 18. Whenever switch device 70 of enable logic circuit 14 is in a state that couples a binary "1" signal from the output of AND gate 22 to timer 84, timer 84 runs. Whenever switch device 70 is in a passing state that passes a binary "0" output signal from AND gate 22 to timer 84, or whenever switch device 70 is in a non-passing state that does not pass any signal from AND gate 22 to timer 84, timer 84 remains reset at zero, and hence does not run.

Signal AAT corresponds to present ambient air temperature and is developed from a suitable temperature sensor mounted on the vehicle to reliably sense ambient air temperature. Signal CAP_AAT_ON represents a predetermined ambient air temperature below which circuit 10 is allowed to be effective to adjust engine idle speed. Whenever the AAT signal falls below the CAP_AAT_ON signal, the output signal from comparator 72 changes from a binary "0" signal to a binary "1" signal so as to cause latch 76 to be set. When latch 76 is set, its output signal, designated CAP_AAT_LATCH, is a binary "1" signal that is supplied to a first of the three inputs of AND gate 88. Signal CAP_AAT_OFF represents a predetermined ambient air temperature above which circuit 10 is disallowed from being effective to adjust engine idle speed. Whenever the AAT signal rises above the CAP_AAT_OFF signal, the output signal from comparator 72 changes from a binary "0" signal to a binary "1" signal so as to cause latch 76 to be reset. When latch 76 is reset, its output signal CAP_AAT_LATCH is a binary "0" signal that is supplied to AND gate 88.

The difference between the values of signals CAP_AAT_ON and CAP_AAT_OFF introduces a certain amount of intentional hysteresis in the switching characteristic of latch 76. For example, if the nominal ambient air temperature at which latch 76 should change state is 0° C. (320° F.), the value of CAP_AAT_ON may correspond to −1° C. (30.2° F.), and that of CAP_AAT_OFF may correspond to 1° C. (33.8° F.). In this way, circuit 10 will be allowed to be effective to adjust engine idle speed whenever the ambient air temperature is below −1° C. (30.2° F.), but the ambient air temperature must thereafter rise above 1° C. (33.8° F.) before circuit 10 is disallowed from being effective.

Signal ECT corresponds to present engine coolant temperature and is developed from a suitable temperature sensor associated with the engine cooling system to reliably sense engine coolant temperature. Signal CAP_ECT_ON represents a predetermined engine coolant temperature below which circuit 10 is allowed to be effective to adjust engine idle speed. Whenever the ECT signal falls below the CAP_ECT_ON signal, the output signal from comparator 78 changes 72 changes from a binary "0" signal to a binary "1" signal so as to cause latch 82 to be set. When latch 82 is set, its output signal, designated CAP_ECT_LATCH, is a binary "1" signal that is supplied to a second of the three inputs of AND gate 88. Signal CAP_ECT_OFF represents a predetermined engine coolant temperature above which circuit 10 is disallowed from being effective to adjust engine idle speed. Whenever the ECT signal rises above the CAP_ECT_OFF signal, the output signal from comparator 78 changes from a binary "0" signal to a binary "1" signal so as to cause latch 82 to be reset. When latch 82 is reset, its output signal CAP_ECT_LATCH is a binary "0" signal that is supplied to AND gate 88.

The difference between the values of signals CAP_ECT_ON and CAP_ECT_OFF introduces a certain amount of intentional hysteresis in the switching characteristic of latch 82. For example, if the nominal engine coolant temperature at which latch 82 should change state is 65° C. (149° F.), the value of CAP_ECT_ON may correspond to 63° C. (145.4° F.), and that of CAP_ECT_OFF may correspond to 67° C. (152.6° F.). In this way, circuit 10 will be allowed to be effective to adjust engine idle speed whenever the engine coolant temperature is below 63° C. (145.4° F.), but the engine coolant temperature must thereafter rise above 67° C. (152.6° F.) before circuit 10 is disallowed from being effective.

Comparator 86 receives a first input signal, designated CAP_ON_TMR, from the output of timer 84. Comparator 86 also receives a second input signal designated CAP_ON_TM. Whenever the latter signal exceeds the former, comparator 86 provides a "0" binary signal to AND gate 88. Whenever the former signal exceeds the latter, comparator 86 provides a binary "1" signal to AND gate 88.

Hence, when vehicle condition logic circuit 12 detects a first set of conditions that are conducive to allowing automatic adjustment of engine idle speed by circuit 10, when enable logic circuit 14 detects a second set of conditions conducive to allowing automatic adjustment of engine idle speed by circuit 10, when engine condition logic circuit 16 detects a third set of conditions conducive to allowing automatic adjustment of engine idle speed by circuit 10, and these first and second sets of conditions have been continuously present for an amount of time established by comparator 86, AND gate 88 switches from delivering a binary "0" logic signal to delivering a binary "1" logic signal to device 90. When AND gate 88 is delivering a binary "1" signal, a change of condition in any of these three sets indicative of a condition that should disallow automatic adjustment of engine idle speed by circuit 10, will cause AND gate 88 to switch back and deliver a binary "0" logic signal to switch device 90.

In addition to switch device 90, PI controller 18 comprises a second switch device 92 (designated TRNS_MODE[PP]). Both switch devices 90, 92 are associated with a proportional and integral control circuit that comprises a proportional circuit 94 and an integral circuit 96. The integral circuit 96 comprises components 96*a*, 96*b*, and 96*c*. PI controller 18 further comprises a maximum engine speed limiter 98 and a maximum engine speed rate-of-change limiter 100.

Switch device 90 receives two input signals, CAP_ECT_DES and ECT. When the output signal from AND gate 88 is a binary "0", device 90 conducts signal ECT to its output, and when the output signal from AND gate 88 is a binary "1", device 90 conducts signal CAP_ECT_DES to its output. The output of switch device 90 is an input to an addition node (+) of an algebraic summing junction 102. Signal ECT is an input to a subtraction node (−)of summing junction 102. The summing junction functions to subtract the signal at its (−)node from the signal at its (+) node. When signal ECT is being coupled through switch device 90, the output from summing junction 102 is zero because the ECT signal is being subtracted from itself. But when AND gate 88 outputs a binary "1" logic signal, the signal ECT is subtracted from the signal CAP_ECT_DES to create an error signal CAP_ECT_ERR that is input to both proportional circuit 94 and integral circuit 96. The proportioned and integrated signal outputs of circuits 94 and 96 respectively are summed together at a summing junction 104, along with a signal N_LIDLE[PP]. Signal N_LIDLE[PP] is a programmable signal that is programmed by the vehicle manufacturer to specify low engine idle speed. The result of the summed signals is an input to limiter 98.

Limiter 98 defines an upper limit value to which the signal from summing junction 104 is maximally limited. The upper limit value is set for limiter 98 by a signal CAP_N_LMX from switch device 92. There are two inputs to switch device 92, a signal CAP_NLMX and a signal CAP_AT_NLMX. Switch device 92 functions to pass one of the two input signals to the exclusion of the other. Which one of the two signals it passes is determined by whether the vehicle transmission is a manual one or an automatic one.

The output signal from limiter 98 is input to rate-of-change limiter 100 which in turn delivers an output signal CAP_N_DES which represents desired engine speed. This desired speed signal is delivered via the engine microcomputer and related circuitry to a speed governor of the engine. In addition, whenever limiter 100 detects a rate-of-change of engine speed exceeding a certain limit, it not only limits the rate-of-change to a defined maximum limit, but also outputs an error flag signal CAPN_ROC_FLG for flagging in the engine microcomputer memory.

Steady state error fault detection circuit 20 comprises a switch device 106 (designated TRNS_MODE[PP]), a first comparator 108, a second comparator 110, a third comparator 112, an AND gate 114, and a timer 116. Comparator 108 compares signal CAP_N_DES and signal CAP N_LMX. Whenever the former signal is greater than or equal to the latter, comparator 108 provides a binary "1" logic output. Whenever the latter is less than the former, comparator 108 provides a binary "0" logic output. Switch device 106 receives two input signals, CAP_ECT_EMX and CAP_ATECTEMX and passes one to the exclusion of the other. Which one is passed is determined by whether the vehicle transmission is manual or automatic.

The output from switch device 106 is input to comparator 110 as signal CAP_ECTER_MX. The other signal input to comparator 110 is signal CAP_ECT_ERR. Whenever the latter exceeds the former, comparator 110 delivers a binary "1" logic signal to AND gate 114, and whenever the former exceeds the latter, comparator 110 delivers a binary "0" logic signal to AND gate 114.

The output of AND gate 114 is an input to timer 116. The output of the timer is supplied as a signal CAP_SS_TMR to one input of comparator 112. The other input of comparator 112 receives a signal CAP_SS_TM that defines an amount of time.

Whenever the error signal CAP_ECT_ERR from summing junction 102 exceeds a certain maximum limit determined by signal CAP_ECTER_MX, the output signal of comparator 110 is a binary "1" logic signal; otherwise it is a binary "0". Whenever the desired engine speed signal CAP_N_DES exceeds a certain maximum limit determined by signal CAP_N_LMX, the output signal of comparator 108 is a binary "1" logic signal; otherwise it is a binary "0".

Steady state error fault detection circuit 20 functions in the following manner. When the engine speed signal that is being sent to the engine speed governor represents a speed that does not exceed the defined maximum engine speed limit provided by signal CAP_N_LMX, the output of comparator 108 is a binary "0" logic signal, forcing the output of AND gate 114 to a binary "0". This keeps timer 116 reset to zero. When the error signal CAP_ECT_ERR is less than the defined maximum allowable engine coolant temperature provided by signal CAP_ECTER_MX, the output of comparator 110 is a binary "0" logic signal, forcing the output of AND gate 114 to a binary "0". This keeps timer 116 reset to zero.

Only when both inputs to AND gate 114 are binary "1" logic signals does timer 116 time. That condition occurs only when both the engine coolant temperature exceeds the defined maximum allowable for circuit 10 to exercise control over engine idle speed, and the error signal CAP_ECT_ERR supplied to the proportional and integral circuits 94, 96 exceeds the defined limit for engine coolant temperature.

Comparator 112 sets a fault flag in the engine microcomputer only after timer 116 has detected both that the engine coolant temperature has continuously exceeded the defined maximum allowable for circuit 10 to exercise control over engine idle speed, and that the error signal supplied to the proportional and integral circuits has continuously exceeded the defined limit related to engine coolant temperature for the amount of time established by signal CAP_SS_TM. Such a fault flag indicates that the engine has reached maximum allowable speed for circuit 10 to exercise control, but that the engine coolant temperature has failed to reach a desired temperature within a pre-allowed time.

While a presently preferred embodiment of the invention has been illustrated and described, it should be appreciated that principles of the invention are applicable to all embodiments that fall within the scope of the following claims.

What is claimed is:

1. An idle speed control for an internal combustion engine comprising:

a first source providing a signal corresponding to ambient air temperature;

a second source providing a signal corresponding to engine coolant temperature;

a third source providing a signal indicating that an engine is running substantially in an idle condition; and a processor that processes the signals from the first source, the second source, and the third source to develop an idle speed control signal for controlling engine idle speed by regulating the engine coolant temperature to a defined coolant temperature when the engine is running in an idle condition and the ambient air temperature does not concurrently exceed a defined air temperature for any ambient air temperature below the defined air temperature, but not when ambient air temperature exceeds the defined air temperature.

2. An idle speed control for an internal combustion engine as set forth in claim 1 in which the processor processes the signals from the first source, the second source, and the third source for controlling engine idle speed by regulating the engine coolant temperature to a defined temperature when the engine is running in an idle condition and the ambient air temperature does not concurrently exceed substantially 0° C. (32° F.).

3. An idle speed control for an internal combustion engine as set forth in claim 1 in which the processor processes the signals from the first source, the second source, and the third source for controlling engine idle speed by regulating the engine coolant temperature to substantially 63° C. (145.4° F.) when the engine is running in an idle condition and the ambient air temperature does not concurrently exceed the defined air temperature.

4. An idle speed control for an internal combustion engine as set forth in claim 1 in which the processor processes the signals from the first source, the second source, and the third source for controlling engine idle speed by regulating the engine coolant temperature to substantially 63° C. (145.4° F.) when the engine is running in an idle condition and the ambient air temperature does not concurrently exceed substantially 0° C. (32° F.).

5. An idle speed control for an internal combustion engine as set forth in claim 1 in which the processor comprises a first hysteresis characteristic that defines upper and lower air temperature switch points for ambient air temperature, the upper air temperature switch point being defined by an upper air temperature above which an air temperature signal from the first source that is increasing from below the upper air temperature switch point will disallow the idle speed control from exercising control of idle speed, and the lower air temperature switch point being defined by a lower air temperature below which an air temperature signal from the first source that is decreasing from above the lower air temperature switch point will allow the idle speed control to exercise control of idle speed, and the processor comprises a second hysteresis characteristic that defines upper and lower coolant temperature switch points for engine coolant temperature, the upper coolant temperature switch point being defined by an upper coolant temperature above which a coolant temperature signal from the second source that is increasing from below the upper coolant temperature switch point will disallow the idle speed control from exercising control of idle speed, and the lower coolant temperature switch point being defined by a lower coolant temperature below which a coolant temperature signal from the second source that is decreasing from above the lower coolant temperature switch point will allow the idle speed control to exercise control of idle speed.

6. An idle speed control for an internal combustion engine as set forth in claim 1 in which the processor comprises a proportional and integral control that processes an error signal developed from engine coolant temperature feedback to the processor to develop the idle speed control signal.

7. An idle speed control for an intern combustion engine comprising:

a first source providing a signal corresponding to bent air temperature;

a second source providing a signal corresponding to engine coolant temperature;

a third source providing a signal indicating that an engine is running substantially in an idle condition; and a processor that processes the signals from the first source, the second source, and the third source to develop an idle speed control signal for controlling engine idle speed by regulating the engine coolant temperature to a defined coolant temperature when the engine is running in an idle condition and the ambient air temperature does not concurrently exceed a defined air temperature;

in which the processor comprises a proportional and integral control that processes an error signal developed from engine coolant temperature feedback to the processor to develop the idle speed control signal, and in which the processor further includes at least one limiter circuit having an input coupled to an output of the proportional and integral control for limiting at least one of, maximum value of and maximum rate-of-change of, an output signal of the proportional and integral control, and in which the at least one limiter circuit further comprises an output at which the idle speed control signal is provided.

8. An idle speed control for an internal combustion engine as set forth in claim 7 in which the at least one limiter circuit comprises two limiter circuits, one for limiting maximum value of an output signal of the proportional and integral control, and another for limiting maximum rate-of-change of the output signal of the proportional and integral control.

9. An idle speed control for an internal combustion engine comprising:

a first source providing a signal corresponding ambient air temperature a second source providing a signal corresponding to engine coolant temperature;

a third source providing a signal indicating that an engine is running substantially in an idle condition; and a processor that processes the signals from the first source, the second source, and the third source to develop an idle speed control signal for controlling engine idle speed by regulating the engine coolant temperature to a defined coolant temperature when the engine is ruing in an idle condition and the ambient air temperature does not concurrently exceed a defined air temperature; and further including an error detector associated with the processor for issuing a fault signal when the engine idle speed exceeds a defined maximum idle speed and the temperature of engine coolant fails to decrease to at least a defined coolant temperature.

10. An idle speed control for an internal combustion engine that powers an automotive vehicle via a vehicle drivetrain comprising:

multiple sources providing respective signals relating to respective parameters of automotive vehicle operation, one of which signals is an ambient air temperature signal; and a processor that processes the respective signals to develop an idle speed control signal that controls engine idle speed when the engine is running in an idle condition and the ambient air temperature does not concurrently exceed a defined temperature for any ambient air temperature below the defined temperature, but not when ambient air temperature exceeds the defined temperature.

11. An idle speed control for an internal combustion engine that powers an automotive vehicle via a vehicle drivetrain as set forth in claim 10 in which another of the signals from the sources is an engine coolant temperature signal, and the processor processes the engine coolant temperature signal as feedback to cause the idle speed control signal to regulate the engine coolant temperature to a defined coolant temperature.

12. An idle speed control for an internal combustion engine that powers an automotive vehicle via a vehicle drivetrain as set forth in claim 11 in which the processor processes the engine coolant temperature signal as feedback to cause the idle speed control signal to regulate the engine coolant temperature to substantially 63° C. (145.4° F.).

13. An idle speed control for an internal combustion engine that powers an automotive vehicle via a vehicle drivetrain as set forth in claim 11 in which the processor processes the engine coolant temperature signal as feedback to cause the idle speed control signal to regulate the engine coolant temperature to a defined coolant temperature when the ambient air temperature does not concurrently exceed substantially 0° C. (32° F.).

14. An idle speed control for an internal combustion engine that powers an automotive vehicle via a vehicle drivetrain as set forth in claim 11 in which the processor processes the engine coolant temperature signal as feedback to cause the idle speed control signal to regulate the engine coolant temperature to substantially 63° C. (145.4° F.) when the ambient air temperature does not concurrently exceed substantially 0° C. (32° F.).

15. An idle speed control for an internal combustion engine that powers an automotive vehicle via a vehicle drivetrain as set forth in claim 11 in which the processor comprises a first hysteresis characteristic that defines upper and lower air temperature switch points for ambient air temperature, the upper air temperature switch point being defined by an upper air temperature above which the ambient air temperature signal, when increasing from below the upper air temperature switch point, will disallow the idle speed control from exercising control of idle speed, and the lower air temperature switch point being defined by a lower air temperature below which the ambient air temperature signal, when decreasing from above the lower air temperature switch point will allow the idle speed control to exercise control of idle speed, and the processor comprises a second hysteresis characteristic that defines upper and lower coolant temperature switch points for engine coolant temperature, the upper coolant temperature switch point being defined by an upper coolant temperature above which the coolant temperature signal, when increasing from below the upper coolant temperature switch point, will disallow the idle speed control from exercising control of idle speed, and the lower coolant temperature switch point being defined by a lower coolant temperature below which the coolant temperature signal, when decreasing from above the lower coolant temperature switch point, will allow the idle speed control to exercise control of idle speed.

16. An idle speed control for an internal combustion engine that powers an automotive vehicle via a vehicle drivetrain as set forth in claim 11 in which the processor comprises a proportional and integral control that processes an error signal developed from engine coolant temperature feedback to the processor to develop the idle speed control signal.

17. An idle speed control for an internal combustion engine that powers an automotive vehicle via a vehicle drivetrain as set forth in claim 11 further including an error detector associated with the processor for issuing a fault signal when the engine idle speed exceeds a defined maximum idle speed and the temperature of engine coolant fails to decrease to at least a defined coolant temperature.

18. An idle speed control for an internal combustion engine that power an automotive vehicle via a vehicle drivetrain comprising:

multiple sources providing respective signals relating to respective parameters of automotive vehicle operation, one of which signals is an ambient air temperature signal; and a processor that processes the respective signals to develop an idle speed control signal that controls engine idle speed when the engine is running in an idle condition and the ambient air temperature does not concurrently exceed a defined temperature;

in which the processor comprises a proportional and integral control that processes an error signal developed from engine coolant temperature feedback to the processor to develop the idle speed control signal, and in which the processor further includes at least one limiter circuit having an input coupled to an output of the proportional and integral control for limiting at least one of, maximum value of and maximum rate-of-change of, an output signal of the proportional and integral control, and in which the at least one limiter circuit further comprises an output at which the idle speed control signal is provided, the at least one limiter circuit comprises two limiter circuits, one for limiting maximum value of an output signal of the proportional and integral control, and another for limiting maximum rate-of-change of the output signal of the proportional and integral control.

* * * * *